US011299920B2

(12) United States Patent
Zhang

(10) Patent No.: US 11,299,920 B2
(45) Date of Patent: Apr. 12, 2022

(54) LOCKING DEVICE AND REFRIGERATOR USING THE SAME

(71) Applicant: Ningbo Eudemon Child Protective Equipment Co., Ltd., Zhejiang (CN)

(72) Inventor: Zhen Zhang, Zhejiang (CN)

( * ) Notice: Subject to any disclaimer, the term of this patent is extended or adjusted under 35 U.S.C. 154(b) by 370 days.

(21) Appl. No.: 16/526,307

(22) Filed: Jul. 30, 2019

(65) Prior Publication Data

US 2020/0040625 A1 Feb. 6, 2020

(30) Foreign Application Priority Data

Aug. 1, 2018 (CN) ..... 201821230806.X

(51) Int. Cl.
*E05C 19/06* (2006.01)
*E05C 19/00* (2006.01)

(52) U.S. Cl.
CPC ..... *E05C 19/06* (2013.01); *E05C 19/007* (2013.01)

(58) Field of Classification Search
CPC . Y10T 16/625; Y10T 292/62; Y10T 70/5062; Y10T 24/45775; Y10T 292/68; Y10T 292/0907; Y10T 292/432; Y10T 292/696; Y10T 24/4019; Y10T 24/45529; Y10T 24/45581; Y10T 279/17256; Y10T 279/182; Y10T 292/0854; Y10T 292/1028; Y10T 292/1089; Y10T 292/18; Y10T 292/294; Y10T 292/314; E05C 19/06; E05C 3/34; E05C 17/28; E05C 19/007
See application file for complete search history.

(56) References Cited

U.S. PATENT DOCUMENTS 2,478,434 A * 8/1949 Swanson ..... E05B 65/5238 292/31
2,489,864 A * 11/1949 Cravener ..... B66C 1/10 294/82.35
2,837,361 A * 6/1958 Loeb ..... E05C 19/04 292/15
4,480,862 A * 11/1984 Fleming ..... E05B 65/087 292/150
4,587,695 A * 5/1986 Jensen ..... A44B 11/253 24/615
5,062,668 A * 11/1991 Onderka ..... H01H 3/163 292/25
5,438,853 A * 8/1995 Bartsch ..... E05B 15/0006 70/69
5,975,592 A * 11/1999 Lin ..... B25G 3/18 292/159

(Continued)

*Primary Examiner* — Mark A Williams

(57) ABSTRACT

The invention discloses a locking device and a refrigerator, wherein the locking device comprises a first lock block and a second lock block; the first lock block comprises a base and a tongue; the second lock block comprises an accommodating cavity, a clamping block, a return spring and a pushing block; the pushing block pushes the clamping block to slide in the sliding groove; and the tongue enters the tongue channel to be engaged with the clamping block so that the two lock blocks are engaged with each other. The locking device has the function of automatically adjusting the height difference between different cabinet doors and cabinet bodies, and is therefore more flexibly suitable for locking various cabinets or refrigerators.

18 Claims, 7 Drawing Sheets

(56) References Cited

U.S. PATENT DOCUMENTS

| | | | | |
|---|---|---|---|---|
| 7,322,127 | B2 * | 1/2008 | Hwang | D06F 39/14 34/603 |
| 7,410,194 | B2 * | 8/2008 | Chen | E05C 1/14 292/37 |
| 10,309,714 | B2 * | 6/2019 | Jin | E05B 65/0042 |
| 10,731,381 | B2 * | 8/2020 | Zhang | E05B 37/16 |
| 2017/0138093 | A1 * | 5/2017 | Wu | E05B 37/0034 |

* cited by examiner

LOCKING DEVICE AND REFRIGERATOR USING THE SAME

FIELD OF THE INVENTION

The invention relates to the field of locks, and particularly to a locking device for locking between a cabinet body and a cabinet door.

BACKGROUND OF THE INVENTION

As babies grow up, their curiosity about the world is also getting stronger and stronger. Babies often rummage through boxes and cabinets in daily life, resulting in some unnecessary dangers. Child safety locks can prevent babies from freely opening cabinet doors, drawers, refrigerator doors, microwave oven doors and the like in houses, thus avoiding rummaging articles, accidentally ingesting or using dangerous drugs or knives, etc.

At present, various kinds of child safety cabinet locks on the market generally have the following disadvantages:

1. the design is so simple that babies can easily unlock the locks, thus failing to provide the purpose of protecting the locks per se;
2. the locks need both hands to operate, and are very difficult to open and very inconvenient to use;
3. the locks need to be removed when in use, and therefore are easy to lose and inconvenient to use; and
4. the locks have a complex overall structure, high cost, a complicated assembly process and low operational reliability.

SUMMARY OF THE INVENTION

An object of the invention is to provide a locking device which has simple design and a simple structure, can be unlocked by one hand, and is easy to assemble and reliable to use.

To achieve the above object, the invention provides the following technical solution.

A locking device comprises a first lock block and a second lock block; the first lock block comprises a base and a tongue fixed on the base; the second lock block comprises an accommodating cavity, a clamping block, a return spring and a pushing block; the accommodating cavity is internally provided with a tongue channel which has an inlet; a sliding groove is at least arranged at one side of the tongue channel, and the clamping block is tensioned in the sliding groove by the return spring; the pushing block pushes the clamping block to slide in the sliding groove; and the tongue enters the tongue channel from the inlet to be engaged with the clamping block so that the first lock block is engaged with the second lock block.

Further, the first lock block is further provided with an adjusting portion which comprises a shaft portion arranged on the base, a sleeve portion arranged on the tongue, a shaft seat and a tension spring; the shaft portion is mounted on the shaft seat; the sleeve portion is fastened outside the shaft portion; the tension spring is fixed between the tongue and the base; and the tongue swings at a slight angle to the base around the shaft portion as an axis.

Further, the tongue channel is internally provided with a guiding portion which is gradually inclined in an ascending manner from the inlet to the inside of the tongue channel.

Further, a wedge block is arranged at a front end of the clamping block, a sliding cavity is arranged on the body of the clamping block, and the sliding cavity comprises a stress surface and a sliding space opposite to the stress surface.

Further, the stress surface is a first inclined surface; the pushing block is provided with a second inclined surface that partially fits against the first inclined surface; and the second inclined surface slides vertically along the first inclined surface and enters the sliding space so that the clamping block slides along the sliding groove.

Further, the accommodating cavity comprises a bottom wall and a cover body, the bottom wall is connected with the cover body through bolts and the sliding groove is arranged on the cover body.

Further, a guiding surface is arranged at the inlet and the guiding surface is flared.

A refrigerator comprises a body and a door hinged on the body, wherein a locking device is arranged between the body and the door. The locking device includes the locking device according to any one of claims 1, 2, 5 and 7.

The invention has the following technical effects:

the locking device can be used for various cabinet doors, can effectively prevent children from opening the cabinet doors, and is simple and practical; and the adjusting portion of the locking device has the function of automatically adjusting the height difference between different cabinet doors and cabinet bodies, thus the locking device is more flexibly suitable for various cabinets, especially for locking refrigerator doors.

Figure 1:
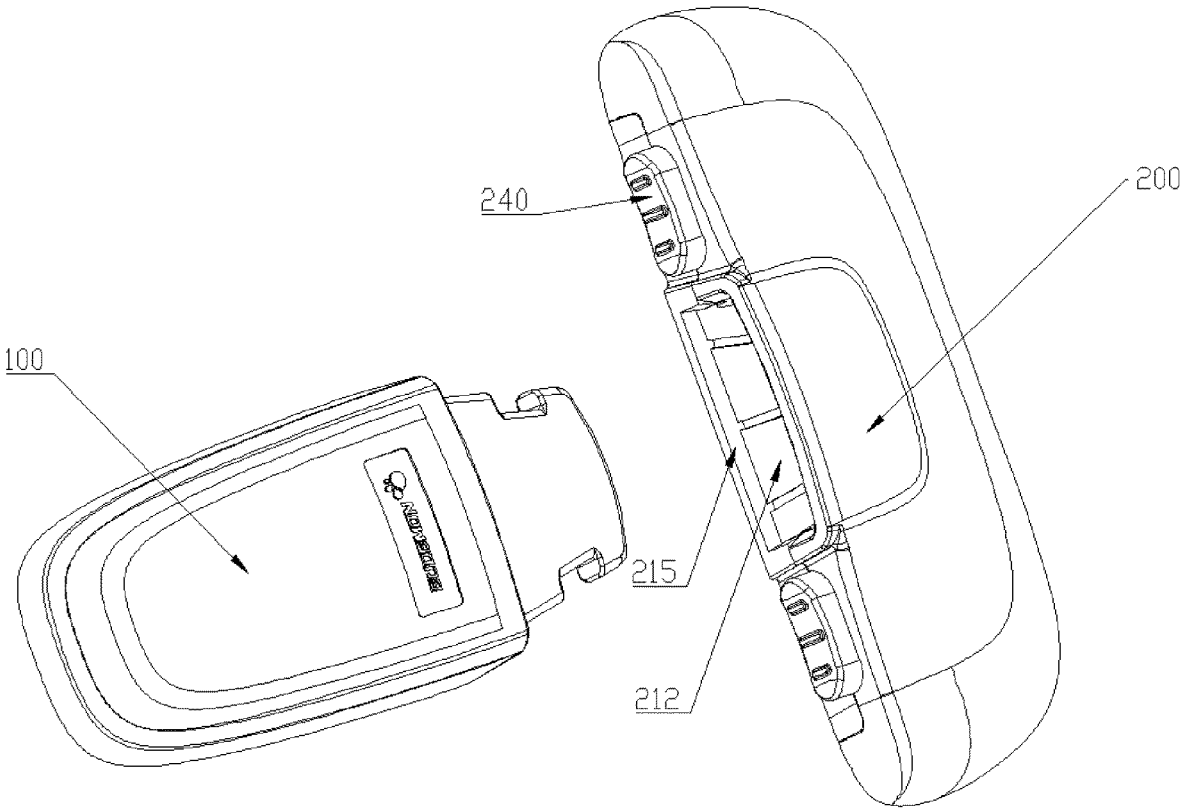
FIG. 1 is a schematic view of the overall structure of the invention.
Figure 2:
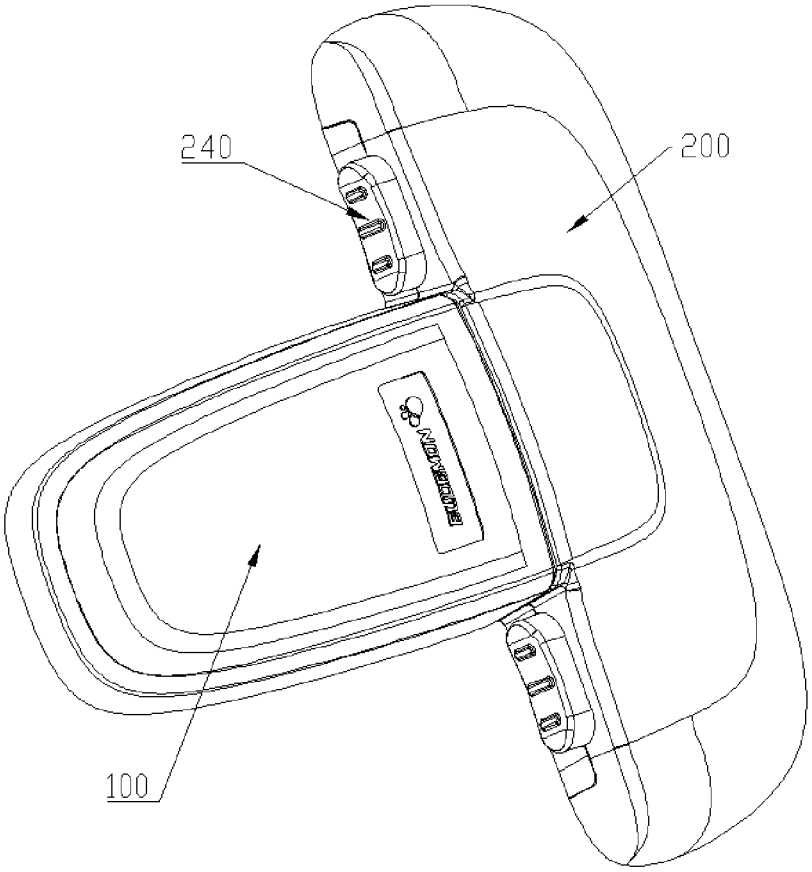
FIG. 2 is a locking schematic view of FIG. 1.
Figure 3:
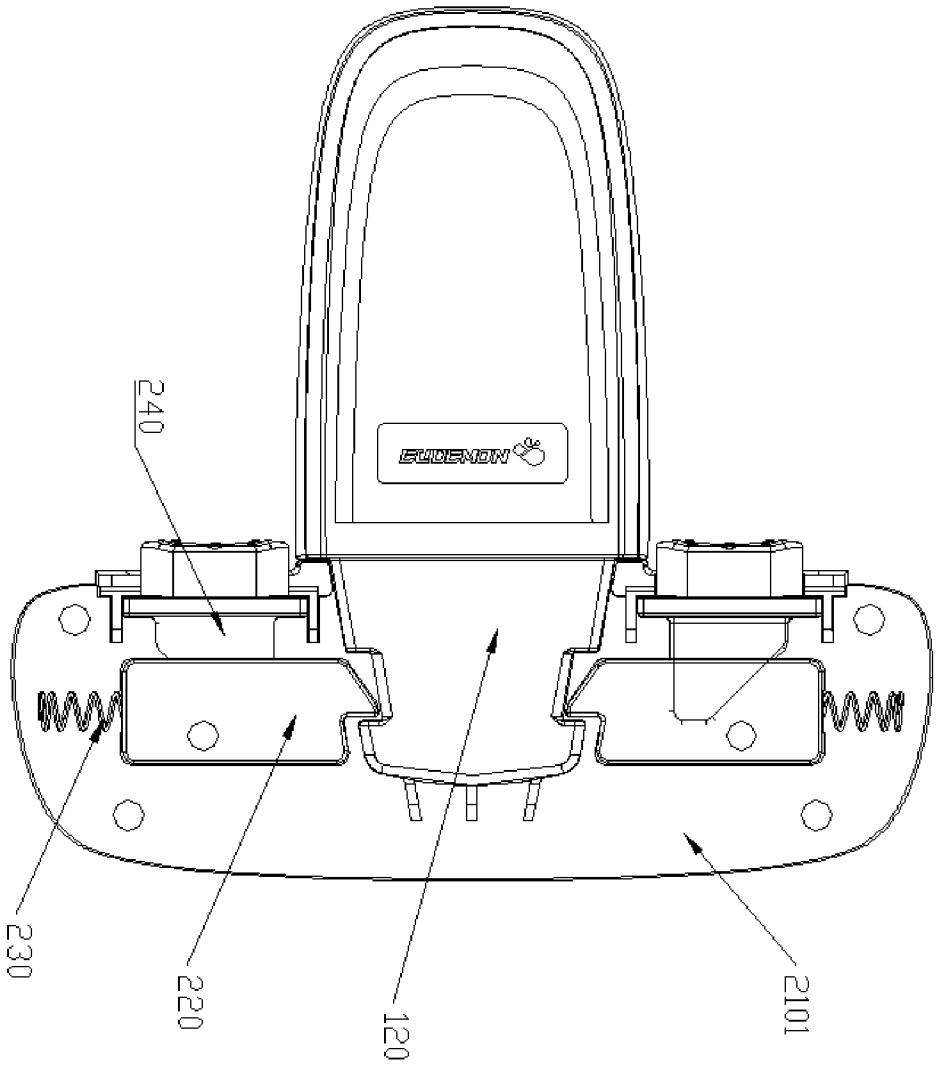
FIG. 3 is a partial cross-sectional view of FIG. 1.

In the above Figures: first lock block 100, base 110, shaft portion 111, sleeve portion 121, tongue 120, shaft seat 130, tension spring 140;

second lock block 200, bottom wall 2101, cover body 2102; tongue channel 211, inlet 212; sliding groove 213, guiding portion 214, guiding surface 215;

clamping block 220, wedge block 221, sliding cavity 222, stress surface 2221, sliding space 2222;

return spring 230; pushing block 240, limiting protrusion 241, second inclined surface 242; straight groove 250, opening 251; body 300, door 310.

DETAILED DESCRIPTION OF THE INVENTION

The invention will be described below in detail with reference to the accompanying drawings and particular embodiments. Herein, illustrative embodiments and illustrations of the invention are only used for explaining the invention, but do not unduly limit the invention.

As shown in FIGS. 1 to 6, a locking device comprises a first lock block 100 and a second lock block 200; the first lock block 100 comprises a base 110 and a tongue 120 fixed on the base; the second lock block 200 comprises an accommodating cavity, a clamping block 220, a return spring 230 and a pushing block 240; the accommodating cavity is internally provided with a tongue channel 211 which has an inlet 212; a sliding groove 213 is at least arranged at one side of the tongue channel 211, and the clamping block 220 is tensioned in the sliding groove 213 by the return spring 230; the pushing block 240 pushes the clamping block 220 to slide in the sliding groove 213; and the tongue 120 enters the tongue channel 211 from the inlet 212 to be engaged with the clamping block 220 so that the first lock block 100 is engaged with the second lock block 200.

In the use of the locking device, the clamping block is tensioned in the sliding groove 213 by the return spring 230, so the tongue 120 is automatically engaged with the clamping block 220 after entering the tongue channel 211; the clamping block 220 is retracted from the tongue 120 by pushing the pushing block 240; and the pushing block 240 can slide in parallel with or perpendicularly to the sliding groove 213, which is not limited herein.

The specific shapes of the pushing block 240 and the clamping block 220 are not limited herein. Generally, those skilled in the art design the shapes according to the needs of customers and the aesthetic needs.

In addition, the arrangement of the sliding groove 213 at one side of the tongue channel can achieve locking and unlocking actions theoretically, but for more stable unlocking and locking, the sliding grooves 213 are symmetrically arranged at both sides of the tongue channel 211.

In addition, the manner of fixing the first lock block 100 and the second lock block 200 on a cabinet body or a cabinet door is not limited herein, and may be by a pressure-sensitive adhesive, a vacuum chuck or a locking screw.

Figure 5:
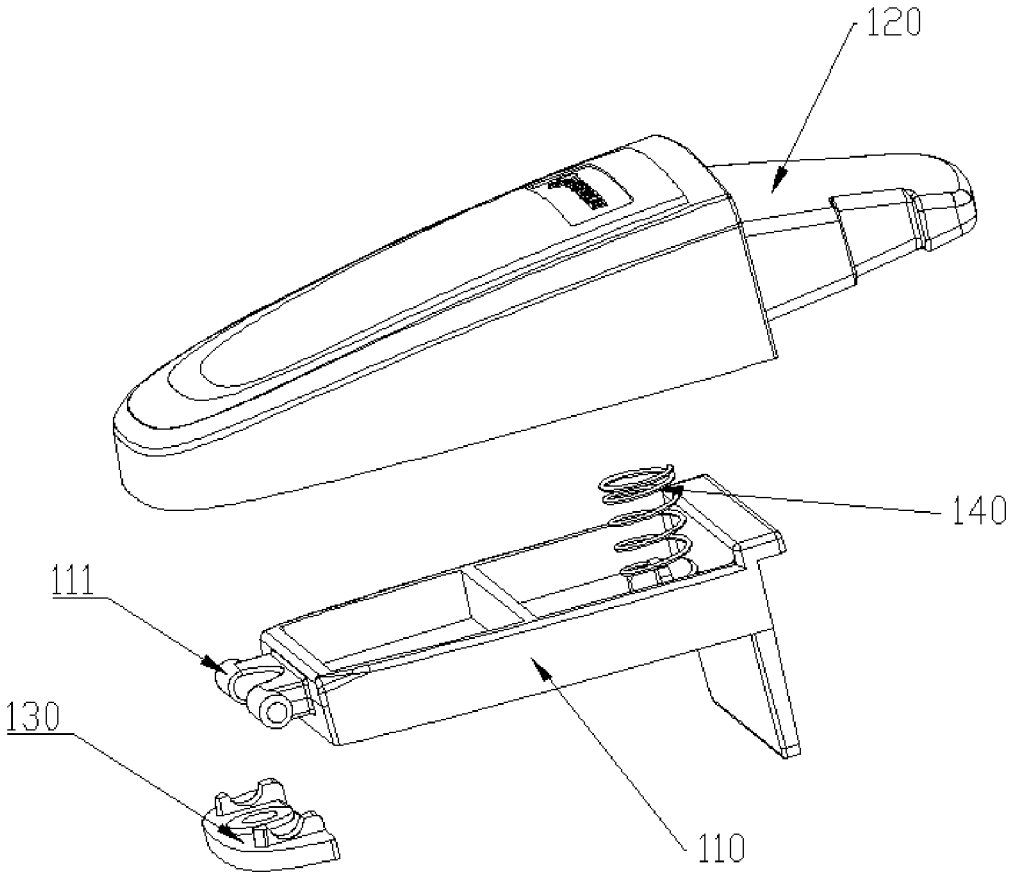
FIG. 5 is a schematic exploded view of a first lock block of FIG. 1.
Figure 6:
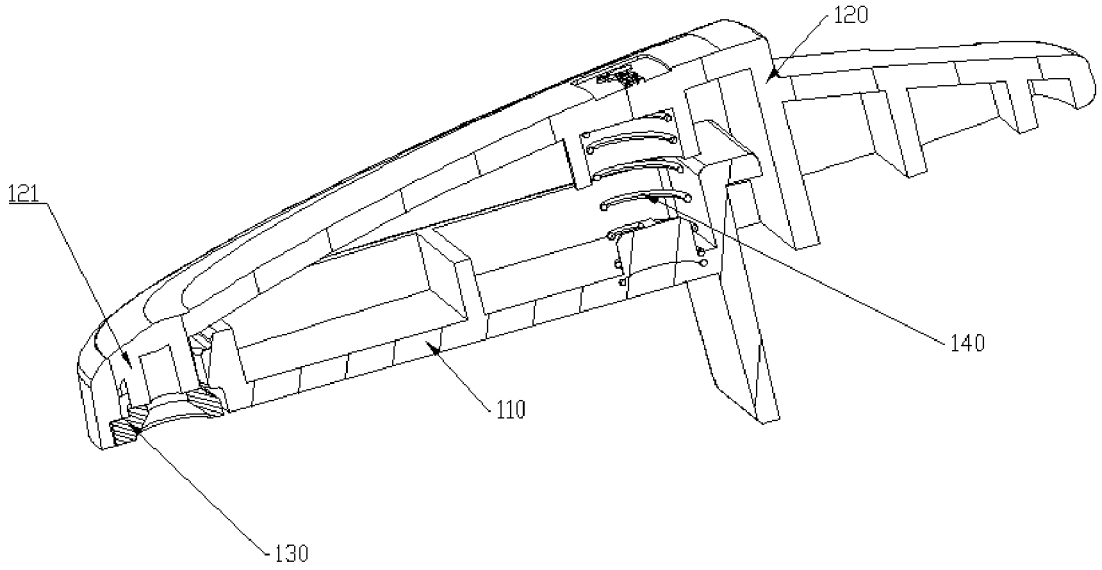
FIG. 6 is a cross-sectional view of FIG. 5.

As shown in FIGS. 5 and 6, the first lock block 100 is further provided with an adjusting portion which comprises a shaft portion 111 arranged on the base, a sleeve portion 121 arranged on the tongue, a shaft seat 130 and a tension spring 140; the shaft portion 111 is mounted on the shaft seat 130; the sleeve portion 121 is fastened outside the shaft portion 111; the tension spring 140 is fixed between the tongue 120 and the base 110; and the tongue 120 swings at a slight angle to the base 110 around the shaft portion 111 as an axis.

In order to better adapt to different cabinets (especially different models of refrigerators), an adjusting portion is arranged here to mainly adjust the height of the tongue 120, thus better adapting to the height difference between different cabinet bodies and cabinet doors. The swing angle is set at about 5° or can be designed according to actual needs, which is not limited herein.

In practical use, if there is a height difference between the first lock block 100 and the second lock block 200 (the inclination angle of the height difference is generally not greater than 5°), the tongue 120 is pressed down so that the tongue 120 swings at a certain angle around the shaft portion 111 as an axis and enters the tongue channel 211 to be engaged with the clamping block 220, thereby locking the cabinet door and the cabinet body.

In order to better implement the locking process of the two lock blocks, the tongue channel 211 is internally provided with a guiding portion 214 which is gradually inclined in an ascending manner from the inlet 212 to the inside of the tongue channel 211.

A specific structure of a clamping block 220 is provided here. A wedge block 221 is arranged at a front end of the clamping block, a sliding cavity 222 is arranged on the body of the clamping block 220, and the sliding cavity 222 comprises a stress surface 2221 and a sliding space 2222 opposite to the stress surface 2221.

The pushing block 240 cooperating with the clamping block 220 may be formed integrally or separately with the clamping block 220. In case of an integral structure, the pushing block 240 may be parallel to the sliding groove 213 where the clamping block 220 is located, and the clamping block 220 is pulled backward to be separated from the tongue 120; or the sliding groove 213 may also be perpendicular to the pushing block 240, and the clamping block 220 is pushed from the side to slide in the sliding groove 213; or other angles are also possible.

If the pushing block 240 and the clamping block 220 are formed separately, the clamping block 220 is provided with a sliding space 2222, a stress surface 2221 is arranged in the sliding space 2222, the pushing block 240 is allowed to move in the sliding space 2222 to contact the stress surface 2221 and overcome the elastic force of the return spring 230, and the clamping block 220 is pushed to slide in the sliding groove 213; and similarly, the angle between the pushing block 240 and the clamping block 220 is arbitrarily set and not limited. For the least effort, it can be set to be perpendicular or parallel so that the stress is maximized.

Figure 4:
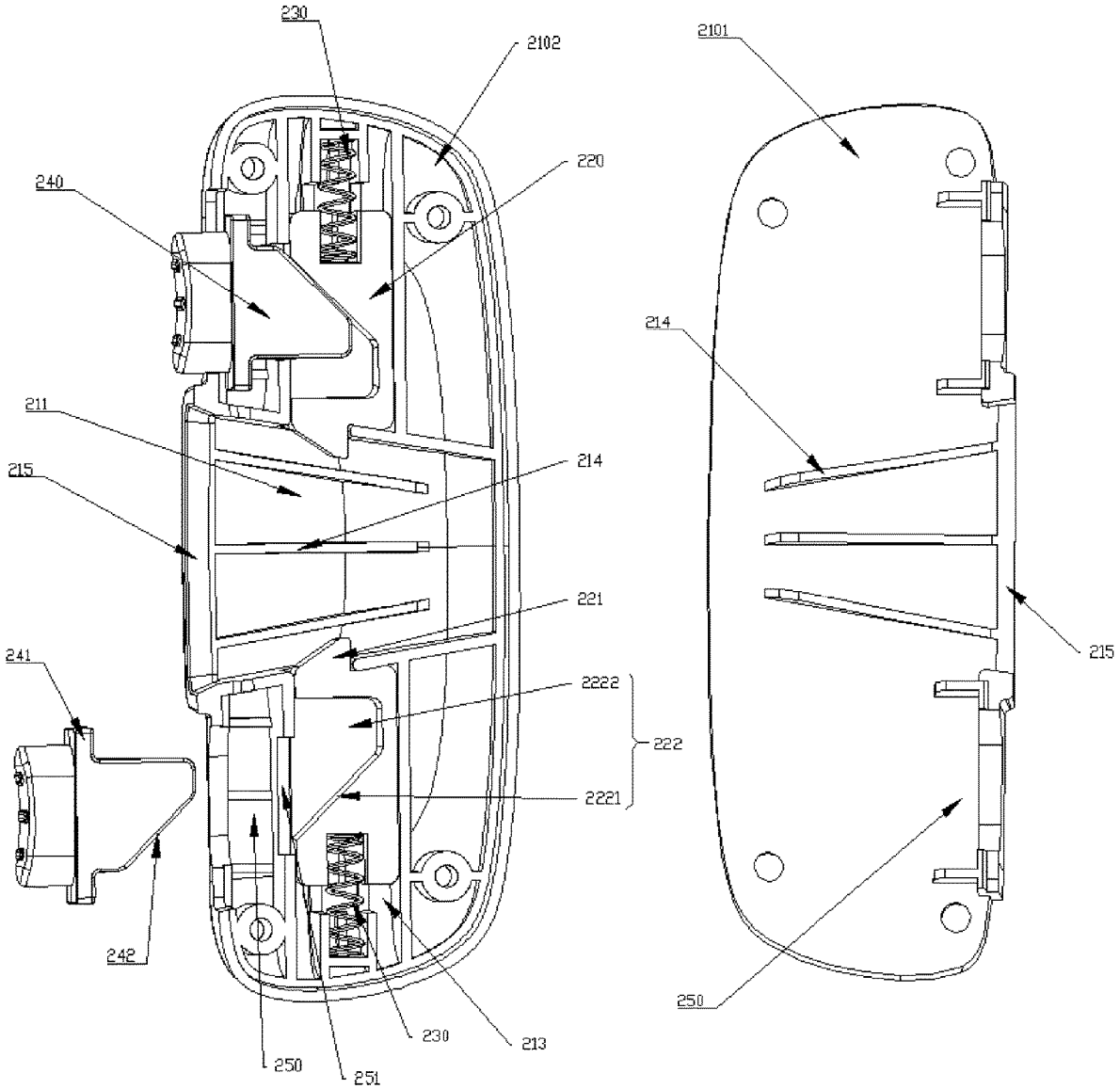
FIG. 4 is a schematic exploded view of a second lock block of FIG. 1.

As shown in FIG. 4, in practical use, in order to facilitate unlocking, the pushing block 240 and the clamping block 220 are arranged separately according to the opening or closing angle of the cabinet door (the refrigerator door), the pushing block 240 is arranged perpendicularly to the clamping block 220, and the stress surface 2221 on the body of the clamping block 220 is arranged as a first inclined surface; the pushing block 240 is provided with a second inclined surface 242 that partially fits against the first inclined surface; and the second inclined surface 242 slides vertically along the first inclined surface and enters the sliding space 2222 so that the clamping block 220 slides along the sliding groove 213. The inclination angle of the inclined surface is preferably 45°.

In use, the pushing block 240 has a limiting protrusion 241 and slides in a straight groove 250 perpendicular to the sliding groove 213, and the sliding groove 213 is provided with an opening 251 communicated with the straight groove 250; the second inclined surface 242 of the pushing block 240 vertically enters the sliding groove 213 from the opening 251 and contacts the first inclined surface, the first inclined surface is stressed so that the clamping block 220 slides in the sliding groove 213, and at the same time, the pushing block 240 enters the sliding cavity 222 until the clamping block 220 is separated from the tongue 120; and in this case, the sliding direction of the pushing block 240 is consistent with the action of opening the door, and the pushing block 240 is pressed in the process of opening the door, so the door is opened more conveniently without additional actions.

For convenience of assembly, the accommodating cavity comprises a bottom wall 2101 and a cover body 2102, the bottom wall 2101 is connected with the cover body 2102 through bolts and the sliding groove 213 is arranged on the cover body 2102.

In order that the tongue slides in more flexibly, a guiding surface 215 is arranged at the inlet 212 and the guiding surface 212 is flared.

Figure 7:
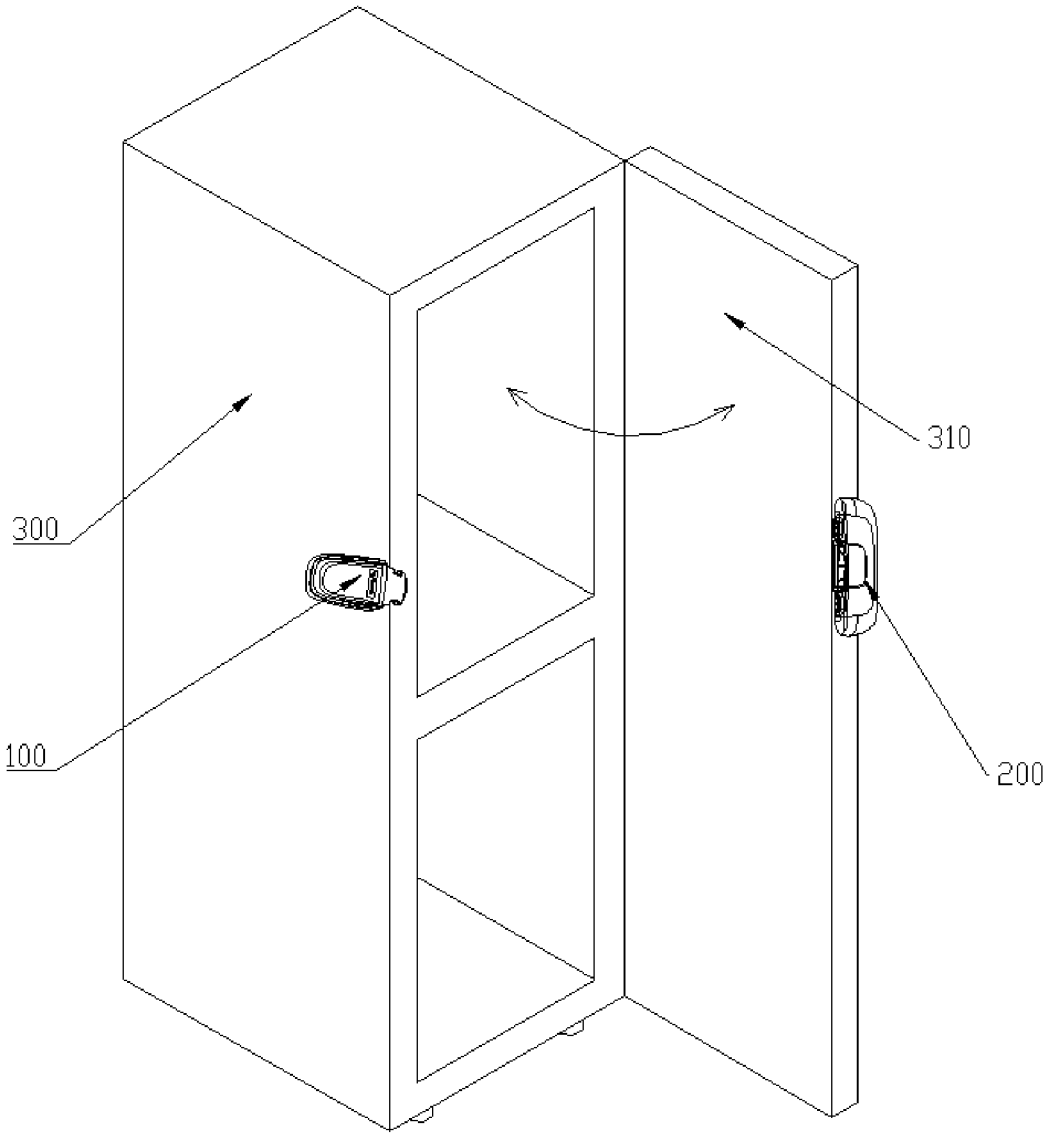
FIG. 7 is a schematic structural view of a refrigerator.

As shown in FIG. 7, in the invention, there is further provided a refrigerator which comprises a body 300 and a door 310 hinged on the body, wherein a locking device is arranged between the body 300 and the door 310. The locking device includes any one of the locking devices described above.

Generally, the first lock block 100 is fixed on the body and the second lock block 200 is fixed on the door, which is more convenient in use.

The above description is not intended to limit the invention, and the invention is also not limited to the above examples. Changes, modifications, additions or substitutions made by those skilled in the art within the essence and scope of the invention are also within the protection scope of the invention.

The invention claimed is:

1. A locking device, comprising a first lock block comprising a base and a tongue fixed on the base;

a second lock block comprising an accommodating cavity, a clamping block, a return spring and a pushing block, the accommodating cavity being internally provided with a tongue channel which has an inlet;

a sliding groove being at least arranged at one side of the tongue channel, wherein the clamping block is tensioned in the sliding groove by the return spring, so that in the case that the tongue enters the tongue channel from the inlet, the clamping block is engaged with the tongue and the first lock block is engaged with the second lock block, wherein the pushing block pushes the clamping block to slide in the sliding groove, so that the clamping block is disengaged from the tongue to lock the first lock block and the second lock block, and wherein the first lock block is further provided with an adjusting portion which comprises a shaft portion arranged on the base, a sleeve portion arranged on the tongue, a shaft seat and a tension spring; the shaft portion is mounted on the shaft seat the sleeve portion is fastened outside the shaft portion; the tension spring is fixed between the tongue and the base; and the tongue swings at a slight angle to the base around the shaft portion as an axis.

2. The locking device according to claim 1, wherein the tongue channel is internally provided with a guiding portion which is gradually inclined in an ascending manner from the inlet to the inside of the tongue channel.

3. The locking device according to claim 2, wherein a wedge block is arranged at a front end of the clamping block, a sliding cavity is arranged on the body of the clamping block, and the sliding cavity comprises a stress surface and a sliding space opposite to the stress surface.

4. The locking device according to claim 3, wherein the stress surface is a first inclined surface; the pushing block is provided with a second inclined surface that partially fits against the first inclined surface; and the second inclined surface slides vertically along the first inclined surface and enters the sliding space so that the clamping block slides along the sliding groove.

5. The locking device according to claim 4, wherein the accommodating cavity comprises a bottom wall and a cover body, the bottom wall is connected with the cover body through bolts and the sliding groove is arranged on the cover body.

6. The locking device according to claim 5, wherein a guiding surface is arranged at the inlet and the guiding surface is flared.

7. The locking device according to claim 1, wherein the accommodating cavity comprises a bottom wall and a cover body, the bottom wall is connected with the cover body through bolts and the sliding groove is arranged on the cover body.

8. The locking device according to claim 7, wherein a guiding surface is arranged at the inlet and the guiding surface is flared.

9. The locking device according to claim 1, wherein the tongue channel is internally provided with a guiding portion which is gradually inclined in an ascending manner from the inlet to the inside of the tongue channel.

10. The locking device according to claim 9, wherein a wedge block is arranged at a front end of the clamping block, a sliding cavity is arranged on the body of the clamping block, and the sliding cavity comprises a stress surface and a sliding space opposite to the stress surface.

11. The locking device according to claim 10, wherein the stress surface is a first inclined surface; the pushing block is provided with a second inclined surface that partially fits against the first inclined surface; and the second inclined surface slides vertically along the first inclined surface and enters the sliding space so that the clamping block slides along the sliding groove.

12. The locking device according to claim 11, wherein the accommodating cavity comprises a bottom wall and a cover body, the bottom wall is connected with the cover body through bolts and the sliding groove is arranged on the cover body.

13. The locking device according to claim 12, wherein a guiding surface is arranged at the inlet and the guiding surface is flared.

14. The locking device according to claim 1, wherein a wedge block is arranged at a front end of the clamping block, a sliding cavity is arranged on the body of the clamping block, and the sliding cavity comprises a stress surface and a sliding space opposite to the stress surface.

15. The locking device according to claim 14, wherein the stress surface is a first inclined surface; the pushing block is provided with a second inclined surface that partially fits against the first inclined surface; and the second inclined surface slides vertically along the first inclined surface and enters the sliding space so that the clamping block slides along the sliding groove.

16. The locking device according to claim 15, wherein the accommodating cavity comprises a bottom wall and a cover body, the bottom wall is connected with the cover body through bolts and the sliding groove is arranged on the cover body.

17. The locking device according to claim 16, wherein a guiding surface is arranged at the inlet and the guiding surface is flared.

18. A refrigerator, comprising a body and a door hinged on the body, a locking device being arranged between the body and the door, wherein the locking device includes the locking device according to claim 1.

* * * * *